United States Patent [19]

Havens

[11] 4,293,126

[45] Oct. 6, 1981

[54] LEG WEIGHTS

[76] Inventor: Donald F. Havens, 1225 S. Chace Ct., Lakewood, Colo. 80226

[21] Appl. No.: 132,339

[22] Filed: Mar. 20, 1980

[51] Int. Cl.[3] ..... A01B 21/26

[52] U.S. Cl. ..... 272/119; 264/273; 156/300; 156/213; 272/71

[58] Field of Search ..... 272/119, 117, 96, 122, 272/123; 264/257, 273; 405/186, 185; 156/300, 213

[56] References Cited

U.S. PATENT DOCUMENTS

| | | | |
|---|---|---|---|
| 2,882,892 | 4/1959 | Kosior | 272/119 |
| 3,114,982 | 12/1963 | McGowan | 272/119 |
| 3,342,036 | 9/1967 | Gruget | 405/186 |
| 3,490,766 | 1/1970 | Gardner | 272/119 |
| 3,932,249 | 1/1976 | Jury | 156/213 |
| 4,239,211 | 12/1980 | Wilkerson | 272/143 |

*Primary Examiner*—Richard J. Johnson

[57] ABSTRACT

A weighted belt for securing to the leg of a swimmer for exercising purposes. The belt is constructed using an elastic latex strip. Lead weights are positioned on the strip, covered by a layer of gauze, which is then covered by the latex material to provide a sealed one-piece structure. The weights have holes therein such that the latex covering material fills the holes to firmly secure the weights to the belt. The ends of the belt are secured by molded buttons on one end engaging openings in the other end.

2 Claims, 1 Drawing Figure

LEG WEIGHTS

Figure 1:
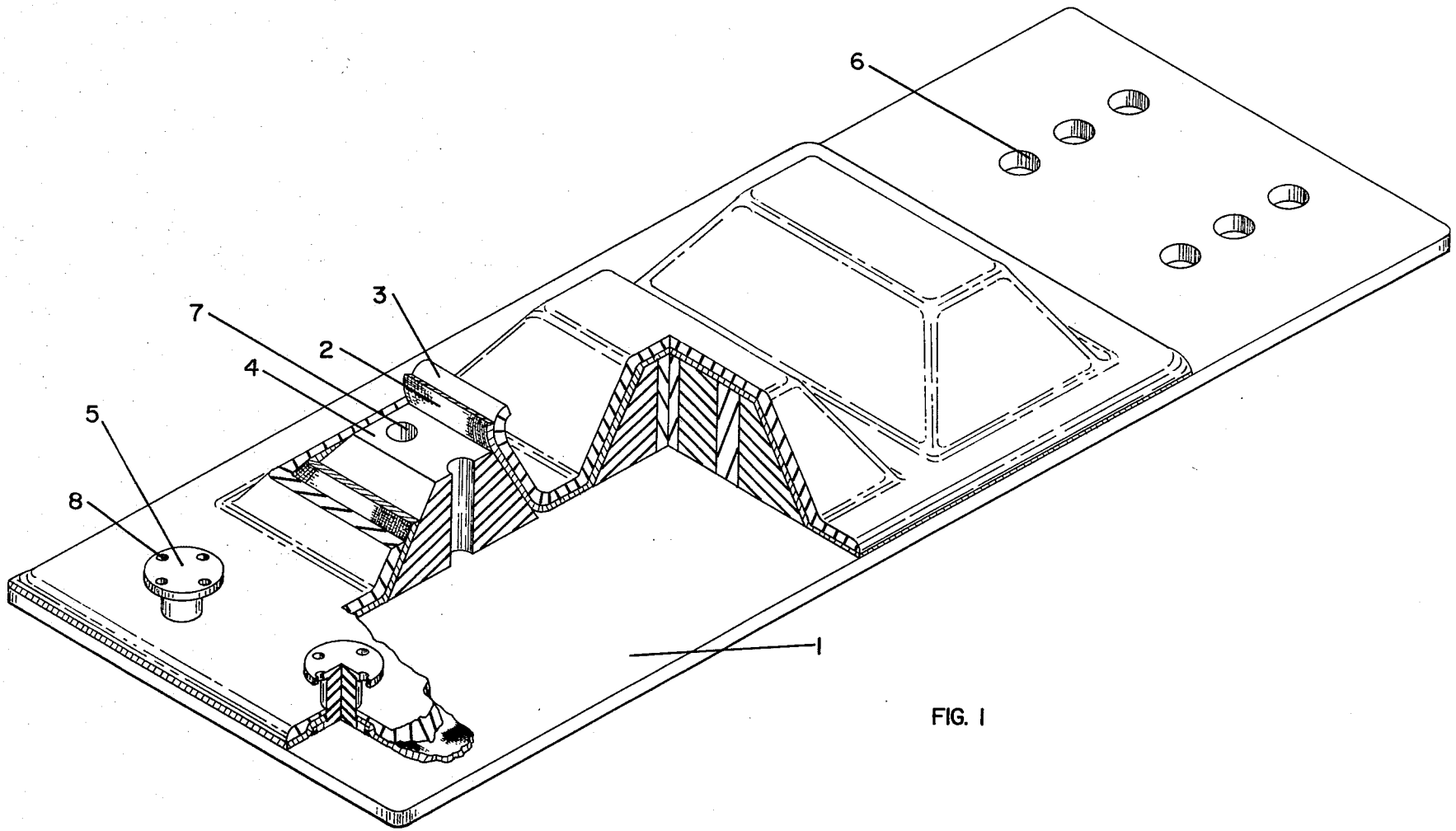

This invention relates to a weighted belt adapted to be worn by a swimmer during swimming for exercising purposes.

Various weighted devices have been used to place an added strain on a users muscles which thus assists in developing and toning the same. In order to be effective such devices must be comfortable when worn and stay securely in place during exercising to eliminate a whiplash effect.

Accordingly, an object of the invention is to overcome objections to existing devices which tend to slip or shift during use and which are uncomfortable to the user.

A further object is to provide a weighted belt which is totally sealed from water and thus has a lengthly period of useful service.

Reference will now be made to the drawing for a detailed description of the invention.

A premolded belt 1 of a strong elastic latex type rubber is provided having a length sufficient to extend around the ankle of a user. Positioned on the belt 1 are a plurality of lead weights 4. Such weights may be of a variety of materials, sizes and shapes. Each of the weights 4 has at least one opening 7 therein for a purpose to be described. Positioned over the weights is a layer of gauze material 2 which extends substantially to the edges of the belt. A plurality of buttons 5 are also positioned on the belt and have flat circular bases covered with the gauze material. Button holes 6 are provided in the opposite end of the belt 1 to mate with the buttons 5.

Liquid latex rubber 3 is then applied over the gauze material entirely sealing same. The latex material 3 passes through the gauze material and the lower openings 8 in the buttons firmly adhering such to the belt 1. The material 3 also fills the openings 7 in the lead weights firmly adhering such to the belt 1. The liquid latex completely seals all of the added parts such that when dry the completed belt comprises a one-piece, seamless waterproof structure that is comfortable to the user and wherein the weights are firmly adhered to the belt and sealed therein.

What is claimed is:

1. A one-piece latex rubber belt having a plurality of weights completely sealed therein, said weights including openings extending entirely therethrough, a layer of gauze positioned over said weights, a layer of liquid latex covering said gauze and filling the openings in said weights to completely seal said gauze and said weights, means for securing the ends of said belt around the ankle of a user comprising a plurality of openings in one end of said belt and a plurality of buttons secured to the opposite end thereof.

2. The weighted belt of claim 1 wherein said buttons include a flat circular base portion having a plurality of openings extending therethrough and latex rubber surrounding the base portions and filling the openings therein.

* * * * *